US007948359B2

(12) United States Patent
Marcelle et al.

(10) Patent No.: US 7,948,359 B2
(45) Date of Patent: May 24, 2011

(54) ELECTRONIC SECURITY DEVICE

(75) Inventors: Jesse A. Marcelle, Muskego, WI (US); Glenn Meekma, Menomonee, WI (US); Vince Leslie, Greendale, WI (US)

(73) Assignee: Master Lock Company LLC, Oak Creek, WI (US)

( * ) Notice: Subject to any disclaimer, the term of this patent is extended or adjusted under 35 U.S.C. 154(b) by 1393 days.

(21) Appl. No.: 11/443,828

(22) Filed: May 31, 2006

(65) Prior Publication Data

US 2006/0283216 A1 Dec. 21, 2006

Related U.S. Application Data

(60) Provisional application No. 60/728,931, filed on Oct. 20, 2005, provisional application No. 60/685,860, filed on May 31, 2005.

(51) Int. Cl.
*E05B 67/24* (2006.01)

(52) U.S. Cl. ..... 340/5.64; 340/5.73; 70/38 A

(58) Field of Classification Search ..... 340/5.25, 340/5.73, 5.64; 70/38 R, 39, 40, 38 A, 38 B, 70/38 C, 275, 277, 278.1, 278.7, 282
See application file for complete search history.

(56) References Cited

U.S. PATENT DOCUMENTS 2,160,294 A 5/1939 Soref
3,477,261 A 11/1969 Siana
3,835,675 A 9/1974 Lippisch
3,979,004 A 9/1976 Bertario
3,979,931 A 9/1976 Man
4,070,882 A 1/1978 Ruiz
4,556,872 A 12/1985 Masoncup et al.
4,609,780 A 9/1986 Clark
4,726,206 A 2/1988 Hsu
4,838,052 A 6/1989 Williams et al.
(Continued)

FOREIGN PATENT DOCUMENTS

CN 1263975 8/2000

OTHER PUBLICATIONS

International Search Report and Written Opinion from PCT International Appln. No. PCT/US06/21071 dated Sep. 27, 2007, 12 pages.

*Primary Examiner* — Edwin C Holloway, III
(74) *Attorney, Agent, or Firm* — Calfee, Halter & Griswold LLP

(57) ABSTRACT

A lock is provided with a housing, a shackle movably coupled to the housing, and a locking arrangement movable between a locked state and an unlocked state. The lock includes a receiver arranged to receive a remote input signal including at least one authorization code. The lock includes a logic applying arrangement programmed to selectively store at least one access code responsive to a corresponding authorization code received by the receiver and to energize the locking arrangement to move from the locked state to the unlocked state when an authorization code received by the receiver corresponds with one of a set of stored access codes. The locking arrangement is configured to secure the shackle within the housing when the locking arrangement is in the locked state, and the locking arrangement is configured to allow the shackle to move relative to the housing when the locking arrangement is in the unlocked state.

21 Claims, 11 Drawing Sheets

U.S. PATENT DOCUMENTS

| | | | |
|---|---|---|---|
| 4,929,880 | A | 5/1990 | Henderson et al. |
| 5,195,342 | A | 3/1993 | Werner |
| 5,280,518 | A | 1/1994 | Danler et al. |
| 5,349,345 | A | 9/1994 | Vanderschel |
| 5,372,019 | A | 12/1994 | Hsiao |
| 5,561,996 | A | 10/1996 | Chang |
| 5,598,725 | A | 2/1997 | Chang |
| 5,727,405 | A | 3/1998 | Cromwell |
| 5,791,172 | A | 8/1998 | Deighton et al. |
| 5,868,013 | A | 2/1999 | Julien |
| 5,927,112 | A | 7/1999 | Yamashita |
| 6,020,827 | A | 2/2000 | Konrad et al. |
| 6,046,558 | A | 4/2000 | Larson et al. |
| 6,047,575 | A | 4/2000 | Larson et al. |
| D427,884 | S | 7/2000 | Castellanos et al. |
| 6,401,501 | B1 | 6/2002 | Kajuch et al. |
| 6,442,983 | B1 | 9/2002 | Thomas et al. |
| 6,517,127 | B1 | 2/2003 | Lu et al. |
| D471,429 | S | 3/2003 | Williams et al. |
| 6,585,302 | B2 | 7/2003 | Lin |
| 6,591,643 | B1 | 7/2003 | Cannella et al. |
| 6,598,439 | B1 | 7/2003 | Chen |
| 6,598,909 | B2 | 7/2003 | Lu |
| 6,761,051 | B1 | 7/2004 | Tsai |
| 6,792,779 | B1 | 9/2004 | Shen |
| 6,807,834 | B2 | 10/2004 | Tsai |
| 6,832,500 | B1 | 12/2004 | Chen |
| 6,898,952 | B1 | 5/2005 | Lin |
| 2005/0099262 | A1* | 5/2005 | Childress et al. ..... 340/5.6 |
| 2005/0156441 | A1 | 7/2005 | Tsai |

* cited by examiner

ELECTRONIC SECURITY DEVICE

CROSS REFERENCE TO RELATED APPLICATIONS

This application claims the benefit of U.S. Provisional Patent Application No. 60/685,860, filed May 31, 2005. This application also claims the benefit of U.S. Provisional Patent Application No. 60/728,931, filed Oct. 20, 2005. The entire disclosures of both applications are hereby incorporated by reference.

FIELD OF THE INVENTION

The present invention relates generally to an electronic security device, and more specifically to an electronically operated padlock.

BACKGROUND OF THE INVENTION

Security devices, such as, for example, padlocks and other types of conventional locks are known in the art, used, for example, to prevent access to a room, building, container, or piece of equipment. Exemplary padlocks include those opened by a key and those opened by manipulation of lock components in accordance with a unique combination. Locks that are opened by a combination require the operator to remember a series of numbers or symbols, and in some cases may be time consuming to open. If the operator cannot remember the combination, the lock must be removed by other less convenient methods, such as, for example, by a bolt cutter. In such a case, the damaged lock must be replaced, resulting in additional inconvenience and expense. Locks that are opened by a key present the risk of key loss or key theft, resulting in a greater potential for unauthorized access to the lock, particularly in cases where the key may be easily duplicated. Again, the replacement of a lock for which security has been compromised results in additional inconvenience and expense.

SUMMARY OF THE INVENTION

The present application relates to the operation of a security device or lock, such as, for example, a padlock, through the use of a motor operated locking arrangement. The lock may utilize a variety of arrangements for providing an authorized signal to operating the locking arrangement, including, for example, use of a key or other instrument provided with electronic circuitry for communicating with the lock, use of a keypad for entry of an authorization code, or use of a remote signal transmitter and corresponding receiver or detector on the lock to remotely transmit an input signal with authorization code to the lock for operation. In one embodiment, one of various remote signaling mechanisms may be used, such as, for example, an infrared (IR) signaling mechanism or a radio transmitter. In an exemplary embodiment, a transmitter is adapted to send a signal to a receiver in the lock, which, through a logic applying arrangement, compares a portion of the signal, such as an authorization code, to a stored access code and energizes a motor in the lock to unlock the locking arrangement if the authorization code corresponds with the access code.

In one embodiment, the receiver may be programmable to add or delete access codes to the logic applying arrangement, allowing a user to expand, limit, or otherwise alter any available electronic access to the locked item. In another embodiment, the lock may be further provided with a manually operable mechanism, such as, for example, a conventional padlock key cylinder mechanism, to allow for manual operation, such as with a key, if the electrical operating mechanism malfunctions, if the electrical mechanism's power source fails, if the signal transmitter is lost, or under other such conditions.

BRIEF DESCRIPTION OF THE DRAWINGS

Further features and advantages of the invention will become apparent from the following detailed description made with reference to the accompanying drawings, wherein.

DETAILED DESCRIPTION

This Detailed Description merely describes embodiments of the invention and is not intended to limit the scope of the claims in any way. Indeed, the invention as described by the claims is broader than and unlimited by the preferred embodiments, and the terms in the specification have their full ordinary meaning.

The present invention provides a security device, such as a padlock, adapted for direct or remote electronic operation in unlocking the device to access a locked item, such as a room, building, container, or piece of equipment, with which the security device is installed. In one embodiment of the invention, a remote signal transmitter is provided to transmit an input signal, such as, for example, an infrared (IR) or radio signal, to a receiver on the lock for operation of a locking arrangement. The receiver transmits the signal to a logic applying arrangement within the lock for energizing the locking arrangement to move from a locked state to an unlocked state. In one embodiment, the logic applying arrangement includes an electrical circuit, such as a controller or microprocessor, for receiving the input signal and decoding the input signal to compare an authorization code in the input signal with a set of one or more access codes stored on the circuit. When the authorization code corresponds with one of the set of access codes, either by matching or otherwise algorithmically corresponding, the circuit energizes a motor in the locking arrangement to move the locking arrangement from the locked state to the unlocked state. In another embodiment, the locking arrangement may be adapted to move from an unlocked state to a locked state, responsive to either the same input signal or a different input signal transmitted to the receiver.

Figure 1:
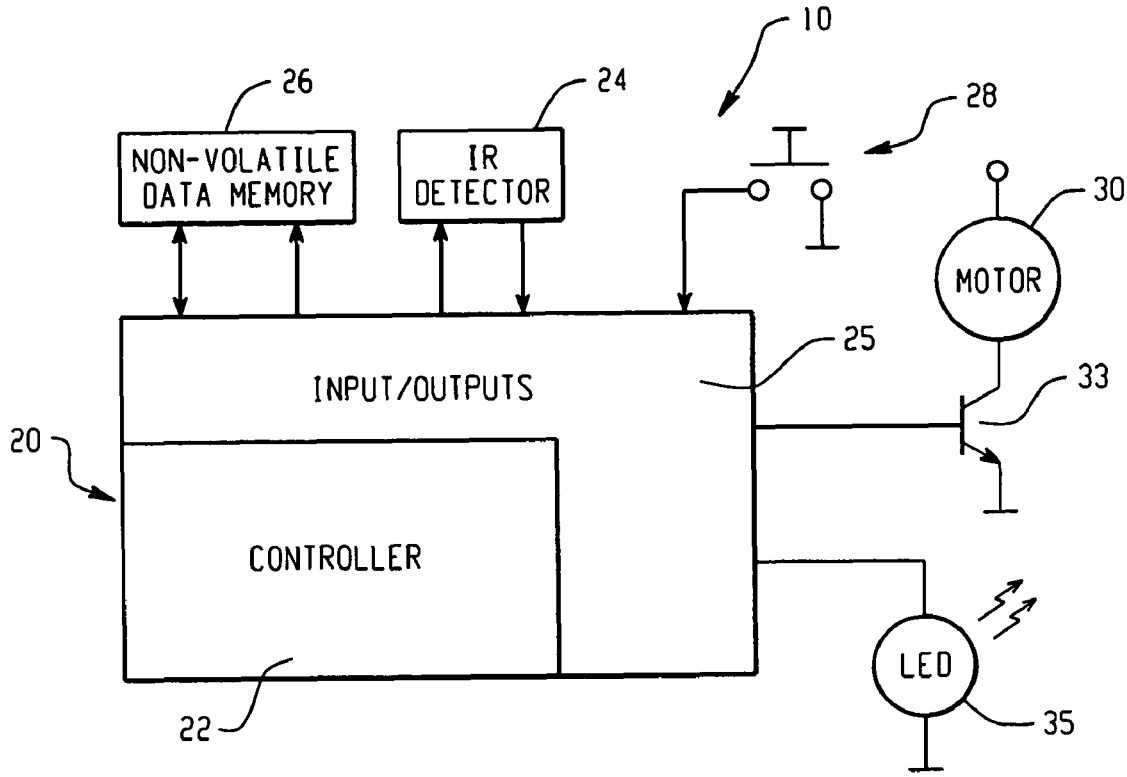
FIG. 1 is a block diagram of a remotely operated lock.

FIG. 1 shows a block diagram of a remotely operated lock 10 according to an embodiment of the invention. The circuit 20 includes a controller microprocessor 22 in circuit communication with a detector or receiver 24 to monitor for input signals received by the receiver and to process or decode the input signal. The microprocessor 22 compares an authorization code of the decoded input signal with a set of one or more access codes stored in non-volatile memory 26 of the circuit 20. When the authorization code corresponds with one of the access codes, the microprocessor 22 provides an output signal to motor 30 for operation of the locking arrangement. As shown, the motor 30 may be driven by a transistor 33, connected between the microprocessor 22 and the motor 30 to provide sufficient current to operate the motor 30. A back diode (not shown) may also be provided across the motor, which may protect the transistor 33, the microprocessor 22, or any other on board device from spikes in electricity. A capacitor, such as a 0.02 uF capacitor (not shown), may also be mounted across terminals of the motor to provide a low impedance termination of electrical brush noise. While the motor of the exemplary embodiment is a direct current (DC) motor, other types of motors may also be used, including, for example, piezoelectric motors or motors using rare earth magnets. As shown, the device 10 may also be provided with a light emitting diode (LED) 35 that may be energized to indicate the receipt of a valid authorization code, as well as other states and conditions in the lock.

While many different types of microcontrollers may be used with the lock, in one embodiment, the microcontroller is provided with: 1K×8 program space, 32 bytes volatile date memory, and speed sufficient to decode a 20 bit data stream in accordance with a firmware specification.

Input/output (I/O) pins 25 associated with the microprocessor 22 may be used for multiple functions to reduce pin count. However, care should be taken to avoid the sharing of an I/O pin for functions that may demand use of the pin at the same time, even if such use only results when a mechanical failure occurs.

In one embodiment, the controller may rely on the actuation of a mechanical switch 28 to provide an indication as to when operation of the motor 30 should be terminated. This may be accomplished by positioning a cam or detent on a rotating component in the lock, such as a shaft or gear, to contact the mechanical switch 28 when the motor 30 has moved the locking arrangement into the desired position.

The IR detector or receiver, according to an embodiment of the invention, includes an IR sensor, a band pass filter with a 38 KHz center frequency, a demodulator, an integrator, and a comparator, to provide a demodulated data signal without the 38 KHz carrier. The receiver may be provided, for example, with a voltage of 3 volts or 5 volts.

Figure 2:
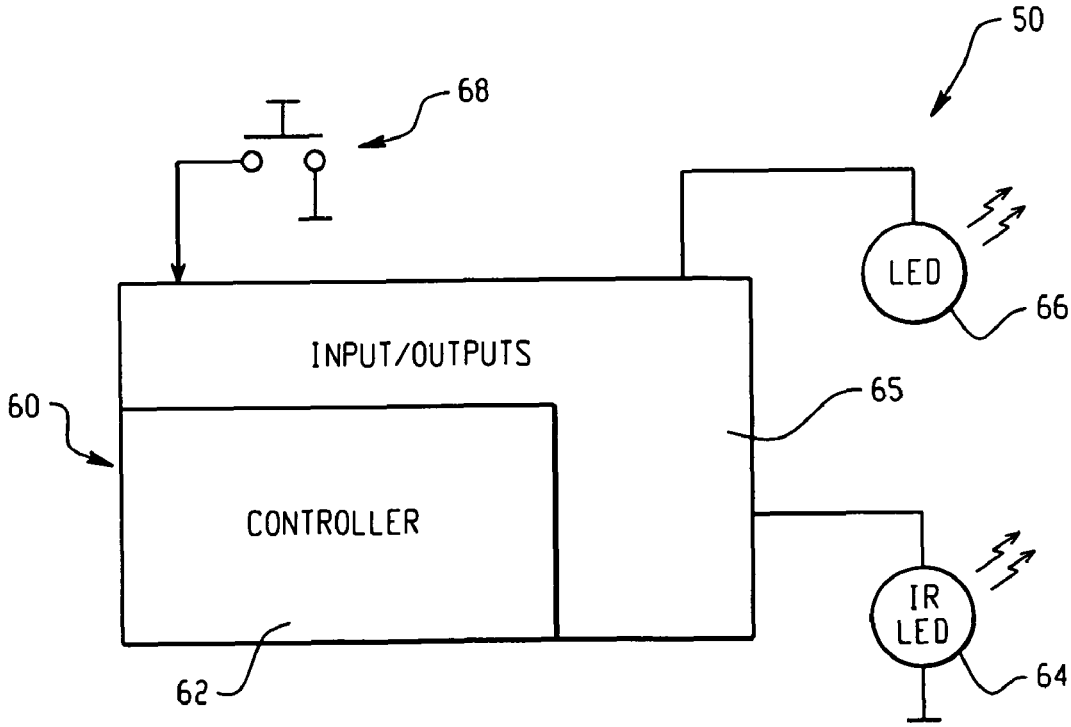
FIG. 2 is a block diagram of a remote signal transmitter.

FIG. 2 shows a block diagram of a key fob or remote signal transmitter 50 according to an embodiment of the invention. The controller or circuit 60 includes a microprocessor 62 in circuit communication with an infrared (IR) LED 64 through I/O pins 65 to emit an input signal to be transmitted to a remotely operated lock in response to an input provided by a switch 68 associated with a button on the key fob. While the illustrated key fob only includes one button, a key fob with multiple buttons to provide multiple input signals or other programming signals may also be provided. The input signal may include a general or family authorization code programmed to correspond with a general or family access code provided in the lock. The general authorization code may be a smaller code, such as an 8-bit code, which serves to identify the input signal as originating from a signal transmitter of a compatible model or style, or of a proper market or distribution channel. The input signal may also include a specific authorization codes programmed to correspond with an access code in a set of stored access codes in the lock. The specific authorization code may be a larger code, such as a 20 bit code, providing for over one million possible codes or combinations. An LED 66 output may also be provided to indicate to the user that the signal has been transmitted. In one embodiment, the LED may be a high intensity LED adapted to direct light towards the lock to allow users to see the lock in the dark. The key fob may also include a battery (not shown) to power the microprocessor 62 and LED's 64, 66. To provide the key fob 50 in a small size, to be easily held in a pocket or purse, the key fob may be powered by a coin cell-type battery. Additionally, the key fob 50 may be provided with a mechanical key (not shown) adapted to operate a manually operable locking mechanism in the lock, as shown in the lock of FIGS. 7-9B. The mechanical key may be pivotally connected and storable in a recess in the fob enclosure when not in use, similar to a jack-knife mechanism.

While many different types of microcontrollers may be used with the key fob, in one embodiment, the microcontroller is provided with: 500×8 bytes program space, 32 bytes volatile date memory, and 3 bytes non-volatile data memory. Additionally, the microprocessor may be provided with a low power usage "sleep" mode that is interrupted by a "watchdog" or interrupt system when the button on the key fob is depressed.

In an embodiment of the invention, the lock is provided with a programmable feature to alter or control access to the lock. For example, a logic applying arrangement in the lock may be adapted to allow additional input signals, such as from additional remote signal transmitters, to operate the locking arrangement for unlocking the lock, by, for example, selectively storing additional access codes corresponding to the additional input signals within the logic applying arrangement. As another example, the logic applying arrangement may be adapted to prevent previously authorized input signals from operating the lock, by, for example, selectively deleting one or more stored access codes corresponding to the unauthorized input signals from the logic applying arrangement.

Since the receiver, circuit, and motor require a power supply to operate, an external (outside the lock) or internal power source may be provided to electrically power these components. In one embodiment, the lock is provided with a battery in circuit communication with the receiver, circuit, and motor for operation of the lock. Since operation of the lock may require continuous monitoring for input signals by the receiver, the preservation of energy consumed may be desirable. In one embodiment, to preserve energy, the lock may be provided with a switch to terminate power to the circuit and receiver when the lock is expected to remain in a locked condition for an extended period of time. In another embodiment, the lock may be adapted to minimize energy consumption while still providing continuous monitoring for an authorized signal. In an exemplary embodiment, the microprocessor may be placed in a sleep mode in which the microprocessor does not decode or analyze all of the input signals received by the receiver.

Figure 3:
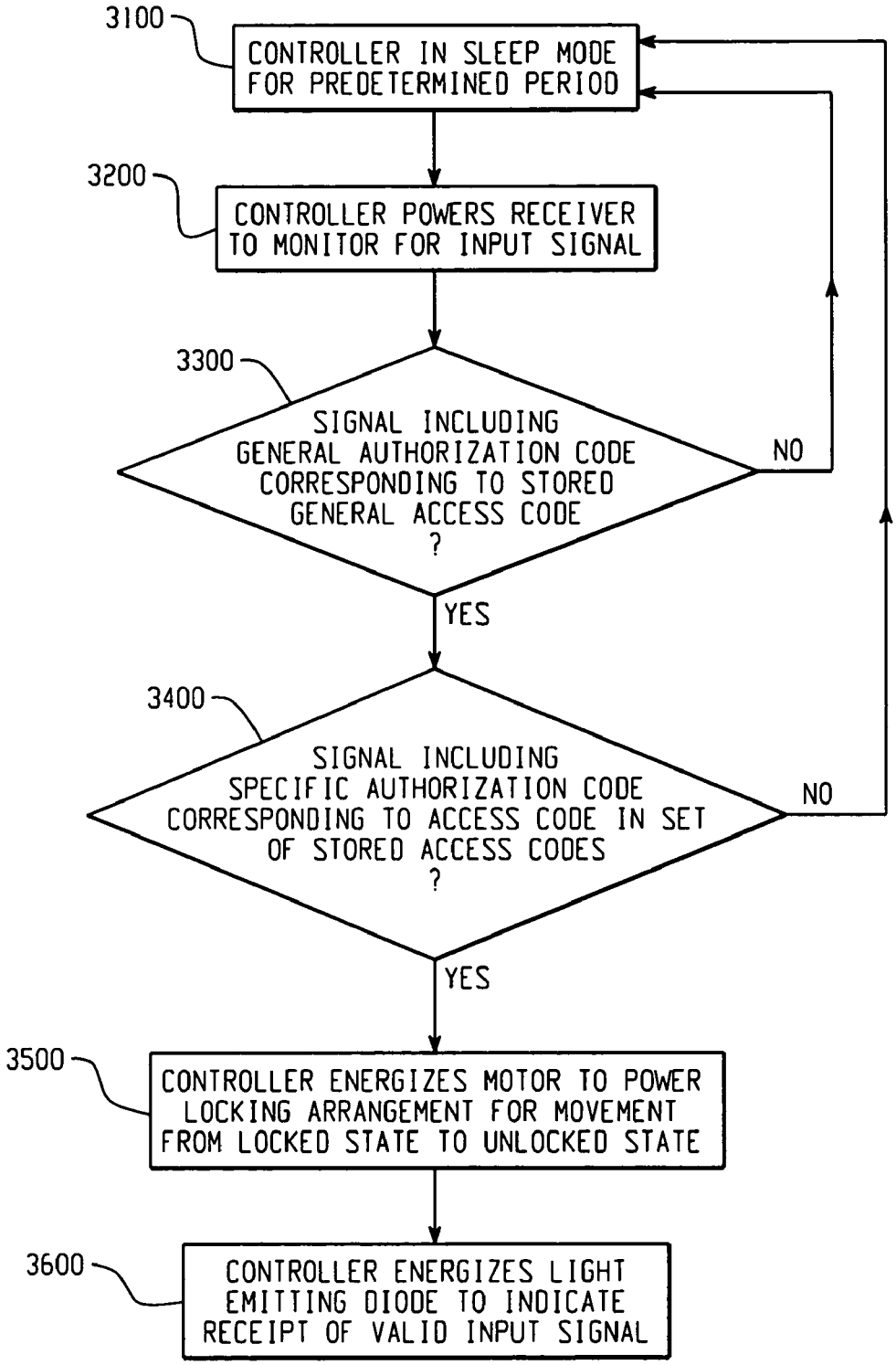
FIG. 3 is a flow diagram of a method for operating a remotely operated lock.

One such method for operating a remotely operated lock is shown in the flow diagram of FIG. 3. To preserve energy, a controller for a lock may be maintained in a sleep mode for a predetermined period, shown in block 3100, in which the controller is not monitoring for input signals and no power is being supplied to any of the lock components. In such a state, power consumption may be minimized; for example, a power consumption of 30 micro watts may be maintained. This predetermined period may vary, and may be based on the amount of time since an authorized input signal was last detected by the controller. In one embodiment, the duration of sleep mode may range from about 2.5 seconds to about 10 seconds. The logic applying arrangement is adapted to extend the duration of sleep mode when the lock has not been accessed for an extended period of time.

At the end of the sleep mode period, as shown in block 3200, the controller powers a receiver to enable it to detect a transmitted signal, and the controller monitors for received signals. Any remote signal transmission and detection may be used, such as, for example, infrared signals and radio signals. As shown in block 3300, if the receiver does not detect a signal including a general authorization code corresponding to a stored general access code, the controller is returned to a sleep mode for a predetermined period (block 3100). If the receiver does detect a signal including a general authorization code correspond to the stored general access code, the controller remains in an active "access" mode and compares a specific authorization code in the input signal with a set of stored access codes (block 3400). If the input signal does not include a specific authorization code corresponding with any of the set of stored access codes, the controller is returned to sleep mode (block 3100). If the input signal includes a corresponding specific authorization code, the processor energizes a motor to power a locking arrangement for movement from a locked state to an unlocked state (block 3500). Additionally, the controller may energize or power an LED to illuminate, to provide an indication to the user that a valid input signal has been received (block 3600). This may be helpful, for example, when there is a mechanical failure in the lock, as it will indicate to the user that a valid input signal was received despite the locks failure to open.

According to another aspect of the invention, a controller in a remotely operable lock may be placed in a learn mode in which one or more new or additional input signals may be transmitted to the microprocessor to be stored as new or additional access codes within the non-volatile memory of the circuit. These access codes may form a set of stored access codes to which an input signal from a remote signal transmitter or key fob may be compared. In one embodiment, a key fob transmitting an input signal corresponding with any one of the set of stored access codes may be used to unlock the lock. In another embodiment, a lock may be adapted to require signals corresponding to more than one stored access code. The controller may be adapted to decode an authorization code included in the input signal to store the code as a corresponding access code.

The controller may alternatively or additionally be placed in a delete or erase mode in which one or more stored access codes may be deleted from the non-volatile memory of the circuit to prevent operation of the lock by a signal transmitter that transmits a signal corresponding to one of the access codes to be deleted. In another embodiment, a delete mode may be provided to erase all access codes stored in the lock, for example, in non-volatile memory associated with the controller. In yet another embodiment, the controller may be adapted to preserve at least one access code, such as an access code originally provided by the manufacturer, to prevent its deletion. In another exemplary embodiment, the controller may be adapted to compare an input signal transmitted while in a general programming mode with the set of stored access codes, and delete a corresponding access code if such an access code is identified. This general programming mode may also allow for the storing of an access code corresponding to a received input signal that does not correspond with any currently stored access codes. Alternatively, or additionally, one or more access codes may be stored in volatile data memory within the circuit, such that an intentional or unintentional loss of power to the circuit may erase the access codes stored in volatile memory.

Figure 4:
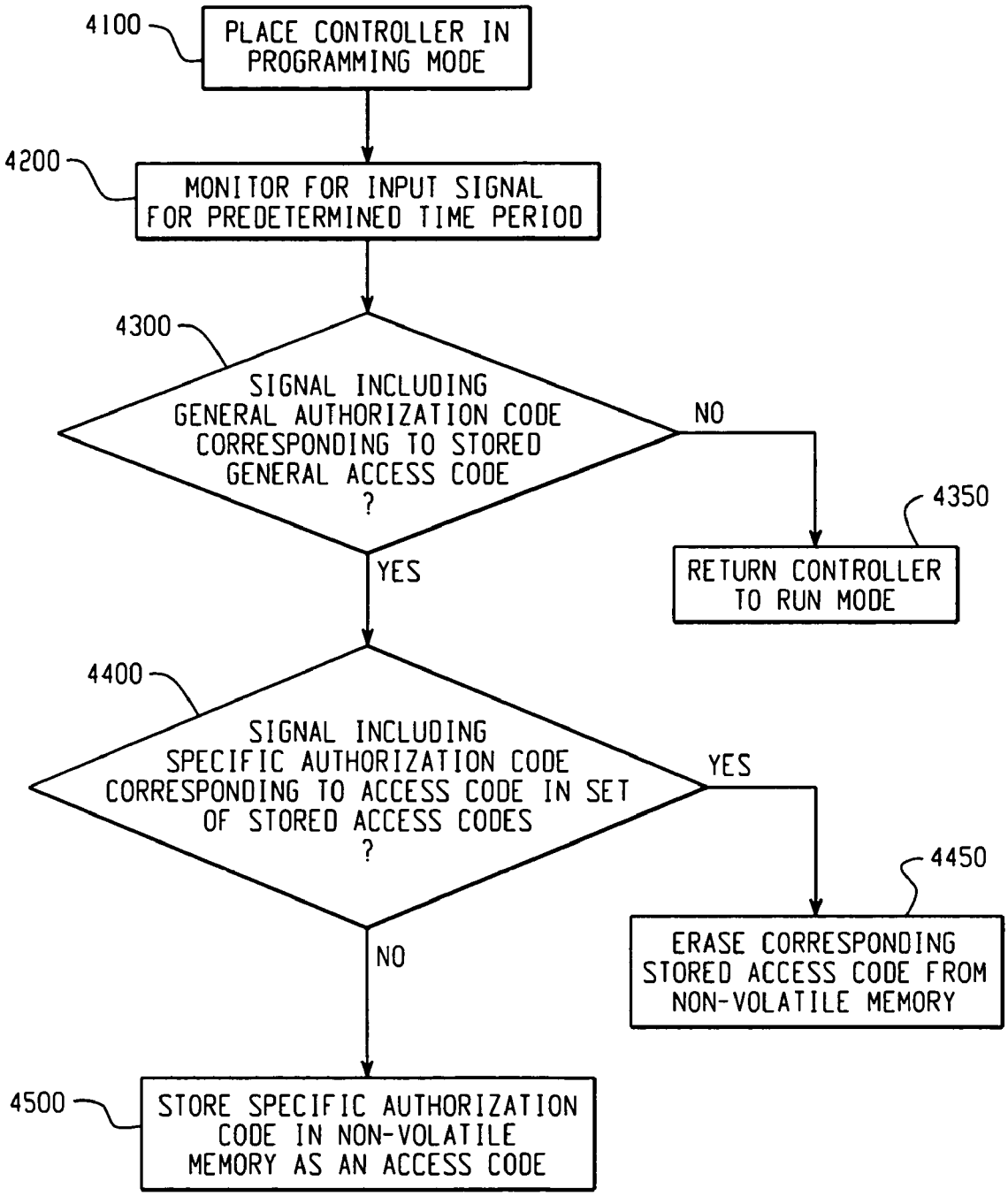
FIG. 4 is a flow diagram of a method for controlling access to a remotely operated lock.

One such method for controlling access to a programmable lock is illustrated in FIG. 4. A controller of a programmable lock is triggered to enter a programming mode, as shown in block 4100. Once the controller is in the programming mode, the controller monitors for input signals received by the receiver for a predetermined period of time (block 4200). While this period of time may vary, since a user has intentionally triggered the learn mode for programming, a relatively short time period, such as, for example, two seconds, may be sufficient. As shown in block 4300, if the receiver does not detect a signal including a general authorization code corresponding to a stored general access code, the controller is returned to a run or operating mode (block 4350). If the receiver does detect a signal including a general authorization code correspond to the stored general access code, the controller compares a specific authorization code in the input signal with a set of stored access codes (block 4400). If the input signal does not include a specific authorization code corresponding with any of the set of stored access codes, the controller stores the specific authorization code as an access code within the set of stored access codes (block 4500). If the input signal does include a specific authorization code corresponding with any of the set of stored access codes, the controller erases the corresponding stored access code from the set of stored access codes (block 4450).

To place a logic applying arrangement of a lock into a programming mode, such as a learn or delete mode as described above, a variety of methods or mechanisms may be provided. As one example, a "mode change" signal may be transmitted to the lock and recognized by the logic applying arrangement, which prompts the logic applying arrangement to enter a learn or delete mode. As another example, a forced loss of power, such as by removal of an internal battery, may cause the logic applying arrangement to enter a learn or delete mode when power is restored. As yet another example, one or more buttons may be provided on the lock, either on an outer surface of the lock or inside the lock and accessible through disassembly of the lock or through an opening in the lock by a pin or other instrument. In one such embodiment, to reduce the number of components and complexity of the lock, one button may be used to enter multiple programming modes by associating a certain frequency or duration of button depressions to a specific intended programming mode. As one example, a programmable padlock may be programmed to enter a learn mode by depressing a learn access button for a first duration range, and to enter an erase or delete mode by depressing the learn access button for a longer second duration range. In another example, the padlock may be programmed to enter an error mode or provide an error signal when the button is depressed for a duration outside the above ranges (i.e., shorter than the first duration range or longer than the second duration range). In yet another exemplary embodiment, the programmable padlock may be provided with an LED to notify the user when the lock has entered learn, delete or error modes, or when the lock has received an authorized signal.

Figure 5:
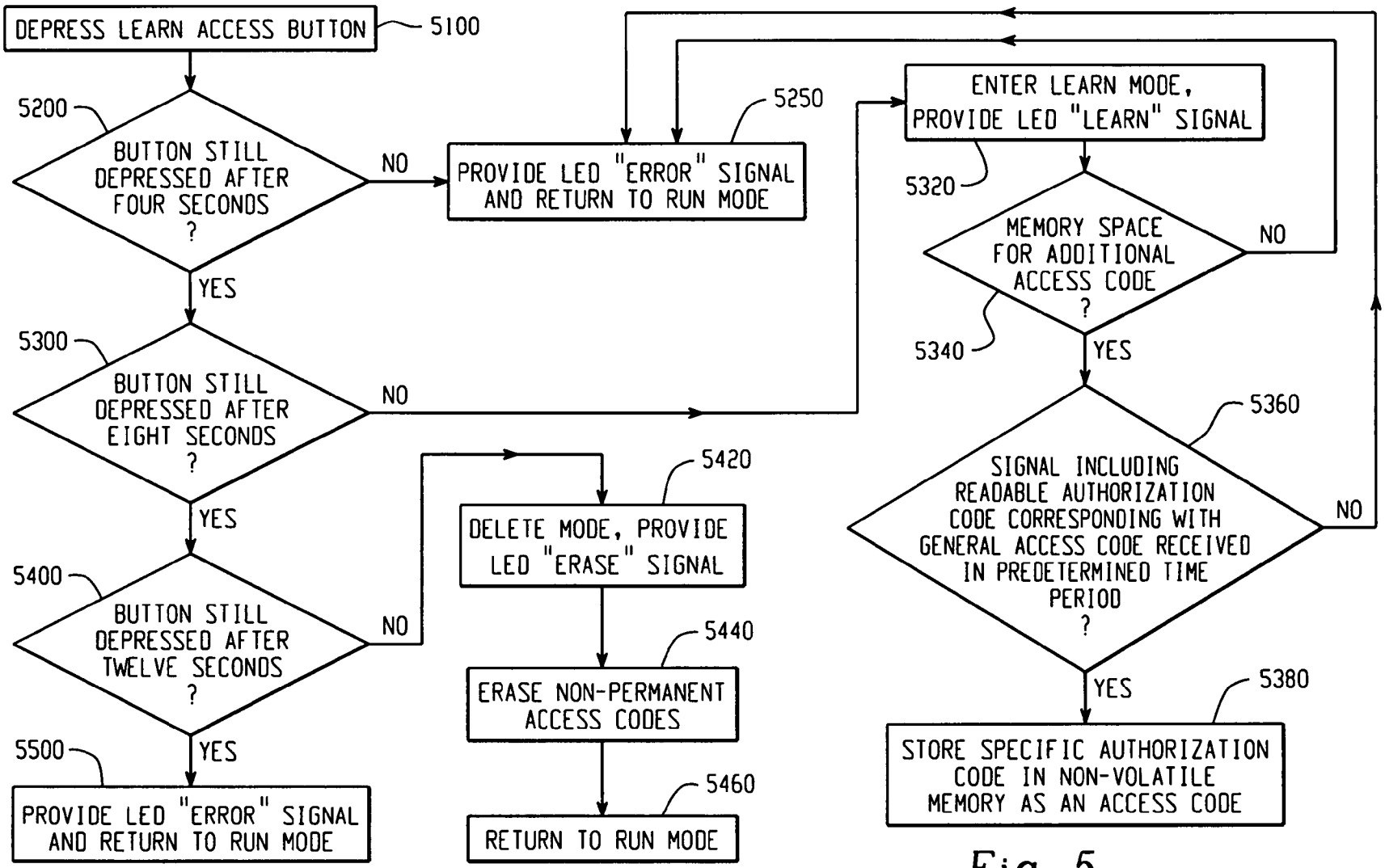
FIG. 5 is a flow diagram of another method for controlling access to a remotely operated lock.

Another exemplary method for controlling access to a programmable lock is illustrated in the flow diagram of FIG. 5. A learn access button on a programmable is depressed to initiate programming of the lock, as shown in block 5100. If the button is depressed for a period shorter than a first duration, such as four seconds (block 5200), the controller powers an LED to provide an "error" signal, such as four light pulses, and the lock returns to a normal operating or run mode (block 5250). If the button is depressed for a first duration range, such as four to eight seconds (block 5300), the controller is triggered to enter a learn mode, and the controller powers an LED to provide a "learn" signal (block 5320), such as two light pulses. The controller then determines if there is memory space available for an additional access code (block 5340). In one embodiment, the lock is provided with sufficient memory space for four additional access codes, in addition to the access code stored in the lock by the manufacturer. However, the lock may be adapted to provide sufficient storage space (through, for example, use of a microcontroller with $E^2$ memory) for any number of stored access codes. If no space is available, the controller powers the LED to provide an "error" signal, and the lock returns to a normal operating or run mode (block 5250). If space is available, the controller monitors for an input signal with a readable authorization code for a predetermined time period (block 5360). If no readable authorization code is detected, the controller powers the LED to provide an "error" signal, and the lock returns to a normal operating or run mode (block 5250). If a readable authorization code is detected, the controller stores the authorization code as an access code (block 5380).

If the button is depressed for a second duration range, such as nine to twelve seconds (block 5400), the controller is triggered to enter a delete or erase mode, and the controller powers an LED to provide a "erase" signal (block 5420), such as three light pulses. Once the controller is in the erase mode, the controller erases non-permanent access codes from the lock's memory (block 5440), such as non-volatile memory, and returns to operating or run mode (block 5460). As discussed above, the lock may be provided with one or more permanent or preserved access codes that are not erased by the controller. If the button is pressed for longer than a second duration range, such as longer than twelve seconds, the controller powers the LED to provide an "error" signal, such as four light pulses, and the lock returns to a normal operating or run mode (block 5500).

Figure 6:
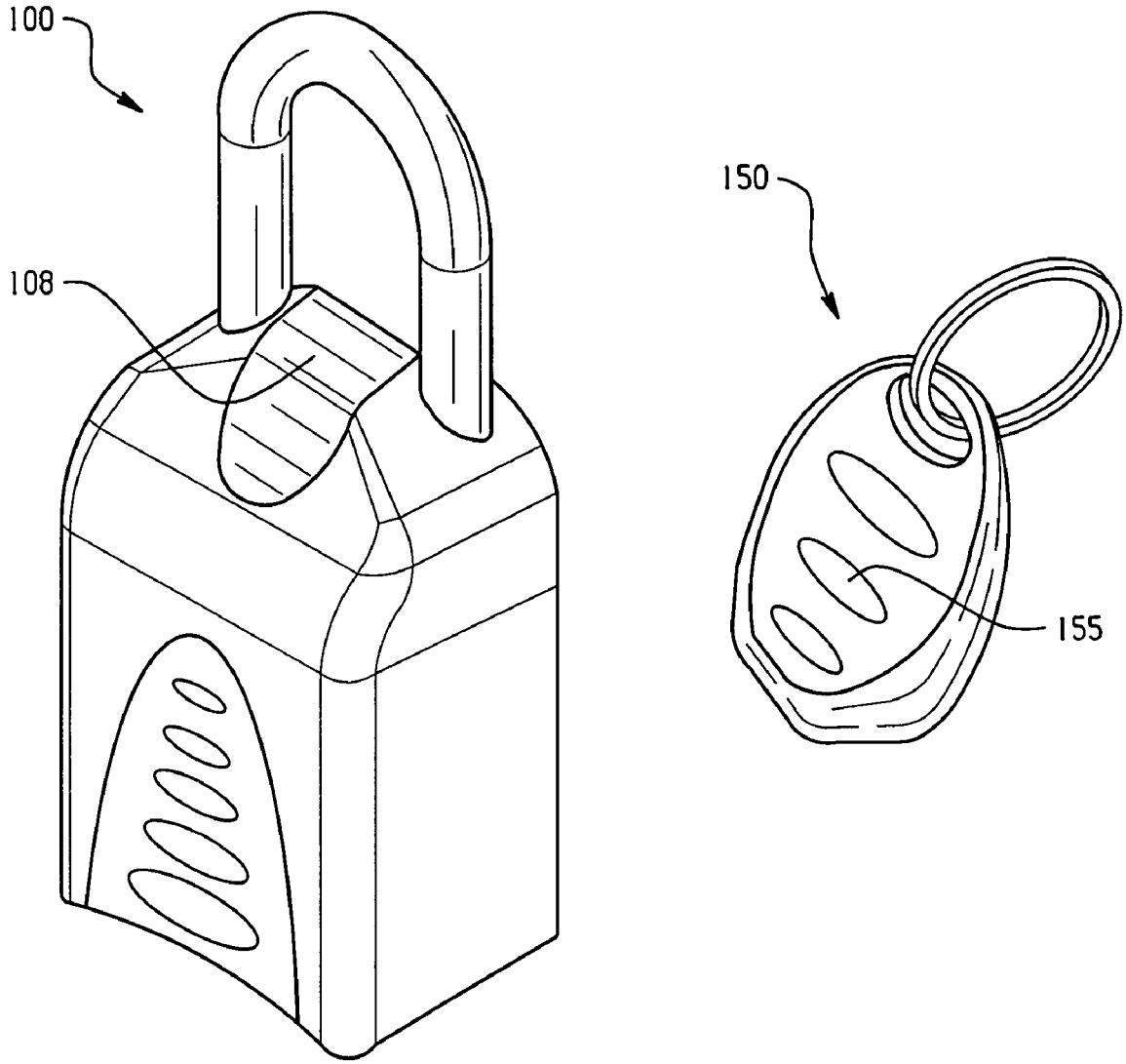
FIG. 6 is a perspective view of a remotely operated padlock and remote signal transmitter.

FIG. 6 illustrates a remotely operated padlock 100 and remote signal transmitter 150 according to one embodiment. It should be apparent to others with ordinary skill in the art that the present invention is not limited to padlocks nor remote signal transmitters. Moreover, the padlock 100 could be opened by other devices and technologies. The illustrated remote signal transmitter 150 is provided as a key fob, which may be sized to be conveniently held on a key chain or in a user's pocket or purse. The transmitter 150 is provided with an activation button 155, which communicates with internal circuitry to produce a signal. While any type of signal may be used with a padlock and transmitter adapted for such use, the illustrated transmitter 150 is provided with an IR light emitting diode (LED) to produce an IR signal to be received by a detector or receiver 108 on the padlock 100. In one embodiment, the padlock 100 and remote signal transmitter 150 may incorporate a logic applying arrangement, such as the logic applying arrangement disclosed in FIGS. 1-5 and described above, to operate the lock from a locked condition to an unlocked condition, responsive to a signal transmitted from the transmitter 150 to the receiver 108.

By utilizing the logic applying arrangement described above or any other suitable operating arrangement, many different locking arrangements may be used to move a lock according to the present invention, such as a padlock, between locked and unlocked conditions. In some such embodiments, a motor included within a padlock may be connected with components of the locking arrangements to disengage one or more shackle engaging members from engagement with a shackle when the locking arrangement is moved from a locked state to an unlocked state, allowing the shackle to move in an opening direction relative to the lock housing. With regard to the exemplary locking arrangements disclosed below, it should be noted that many of the disclosed inventive features may be used with many types of padlocks, including, but not limited to, electrically operated locks, such as remote control locks, pushbutton/key code-type locks, and locks using mechanical keys with electrical circuit-forming features; and manually operated locks such as key operated padlocks, as well as electrically operated locks with a manually operated override feature.

Figure 7:
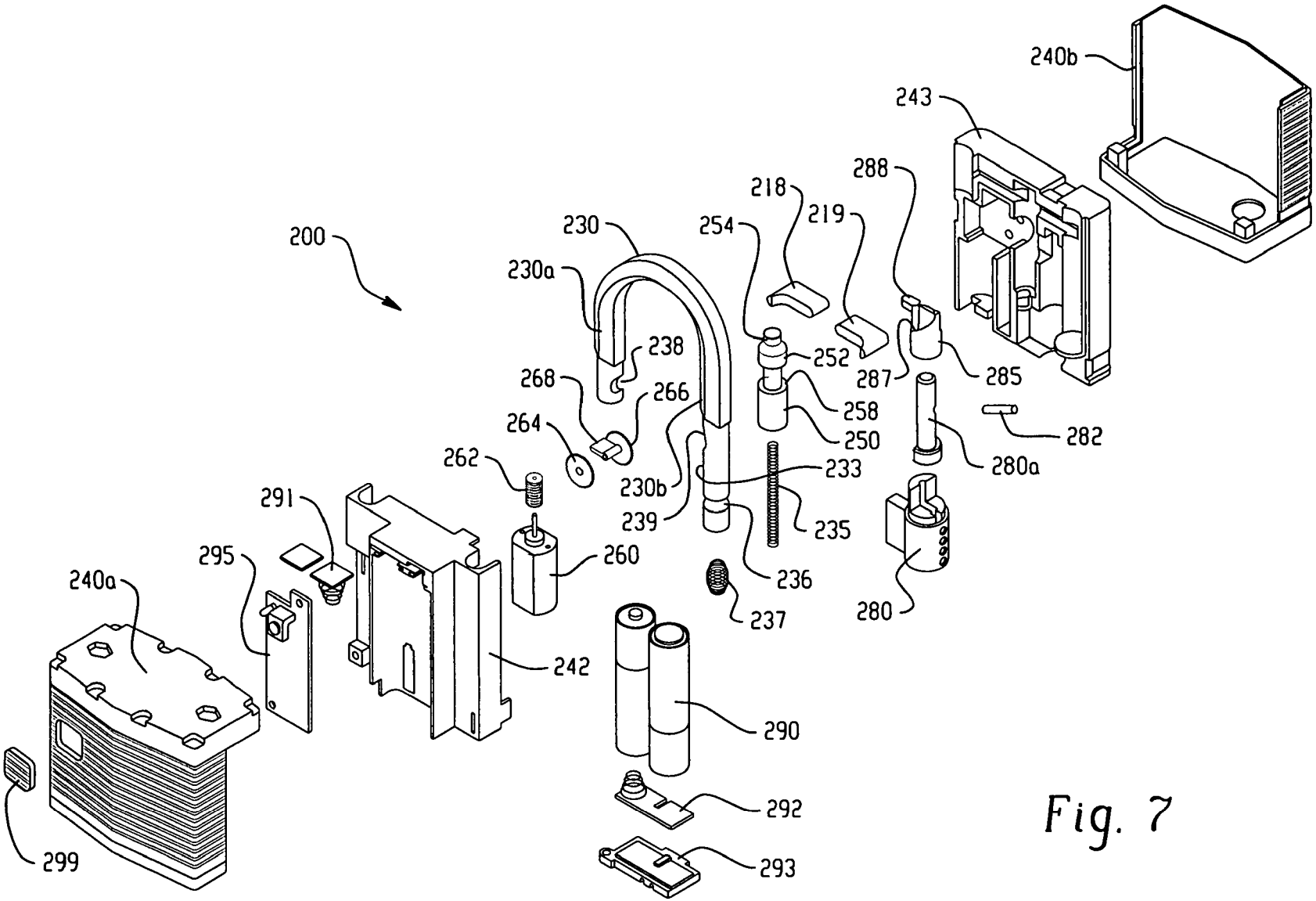
FIG. 7 is an exploded view of a remotely operated padlock.

FIGS. 7-9B illustrate one such exemplary padlock 200 according to the present invention. The padlock 200 includes a shackle 230 movable between locked and unlocked positions, in which a short leg 230*a* of the shackle 230 disengages from a lock housing 240 when the lock is opened, while a long leg 230*b* of the shackle 230 remains engaged within the lock housing 240. As shown in FIG. 7, the lock housing may include two halves 240*a*, 240*b* assembled with suitable fasteners. A pair of shackle engaging members 218, 219 engage corresponding locking recesses 238, 239 in the shackle to secure the shackle when the padlock 200 is in the locked condition. A "recess," as used herein, may include any type of groove, notch, hole, or other such feature adapted to engage a portion of the corresponding shackle engagement member. When the lock 200 is unlocked, the shackle engagement members 218, 219 are disengaged from the locking recesses 238, 239 to allow the shackle 230 to be moved in an opening direction. In the embodiment of FIGS. 7-9B, the shackle engagement members 218, 219 are pins that are slideable to engage and disengage with the locking recesses 238, 239. While only one shackle engagement member may be required, the use of two shackle engagement members (one for each leg of the shackle) provides a double locking lever mechanism for the padlock, to prevent the shackle from being temporarily jarred or knocked out of engagement with the engagement member by an impact with the padlock.

Figure 8B:
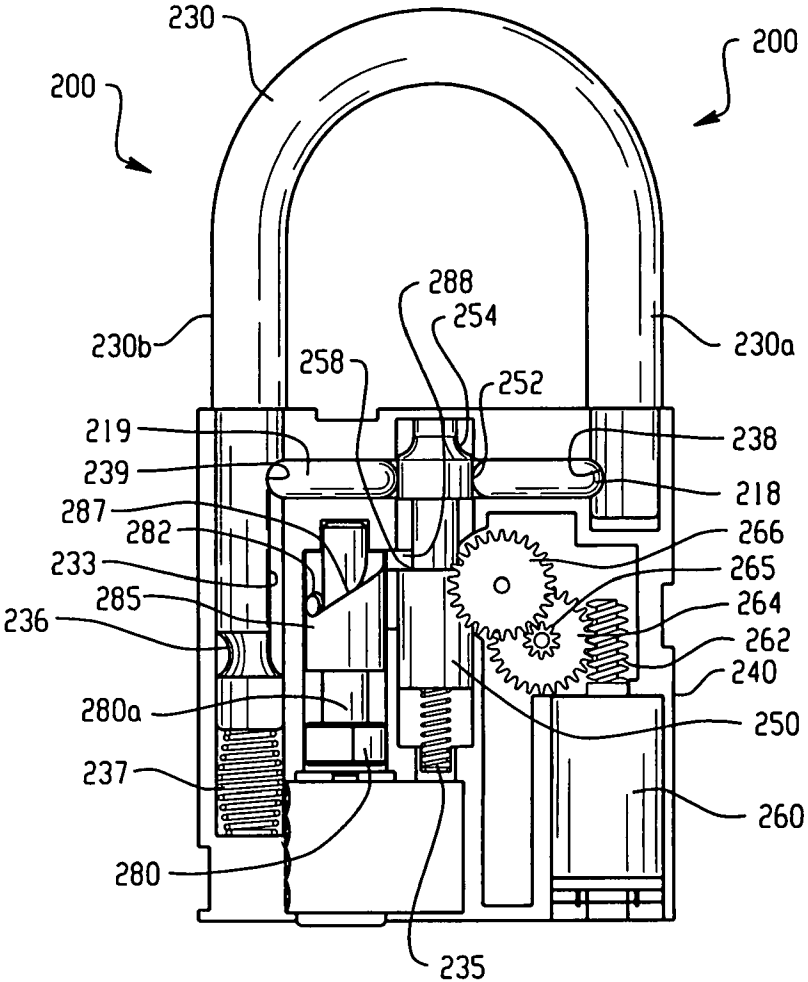
FIG. 8B is a rear cross-sectional view of the padlock of FIG. 7 in a locked condition.
Figure 8A:
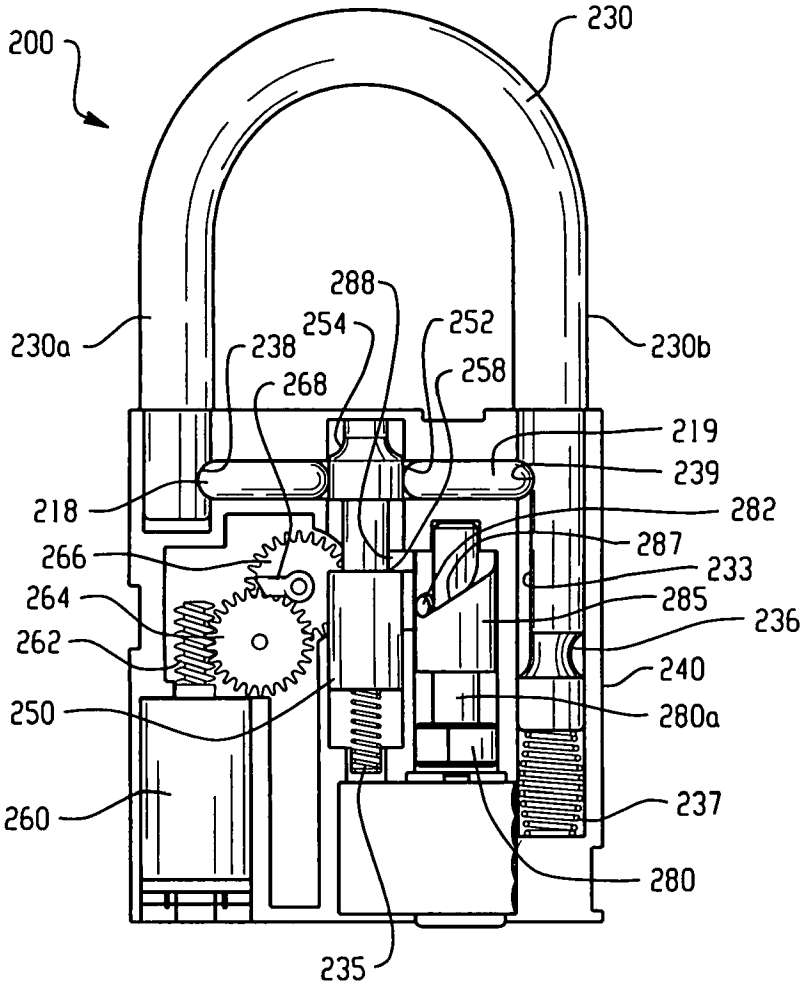
FIG. 8A is a front cross-sectional view of the padlock of FIG. 7 in a locked condition.

According to one aspect of the present invention, a padlock may be provided with a moveable shaft adapted to directly or indirectly move one or more shackle engagement members between positions of engagement and disengagement with corresponding locking recesses in the shackle. The shaft, which may be provided in any number of shapes, sizes, and orientations, may be directly or indirectly coupled to the shackle engagement members, and may be moveable in many different ways, such as, for example, sliding, rotating, or pivoting movement, to effect movement of the shackle engagement members. In one example, the shaft may function as a plunger or post blocker to selectively prevent or allow disengagement of the shackle engagement members from the shackle. In the illustrated embodiment of FIGS. 7-9B, the post blocker or shaft 250 is an elongated, generally cylindrical member provided with an outer surface 252 and an unlocking recess 254 at an upper end of the shaft 250 that is contoured inward from the outer surface 252. When the shackle engagement members 218, 219 are aligned with the outer surface 252 of the shaft 250, as shown in FIGS. 8A and 8B, the shackle engagement members 218, 219 are retained in an engaged position with the locking recesses 238, 239. When the shackle engagement members 218, 219 are aligned with the unlocking recess 254 of the shaft 250, the shackle engagement members 218, 219 are allowed to slide into engagement with the unlocking recess 254, thereby disengaging from the locking recesses 238, 239 of the shackle 230 to allow the shackle to move in an opening direction.

According to another aspect, a padlock may be provided with a lock biasing member, which may either directly or indirectly bias one or more shackle engagement members towards a position of engagement with the shackle. This lock biasing member may include one or more of any number of springs, tabs, or other such components. In the exemplary embodiment of FIGS. 7-9B, the lock biasing member 235 includes a spring positioned below the shaft 250 to bias the shaft 250 upward, which in turn aligns the shackle engagement members 218, 219 with the outer surface 252 (i.e., misaligning the shackle engagement members with the unlocking recess 254) to bias the shackle engagement members into engagement with the locking recesses 238, 239 of the shackle 230.

Figure 9B:
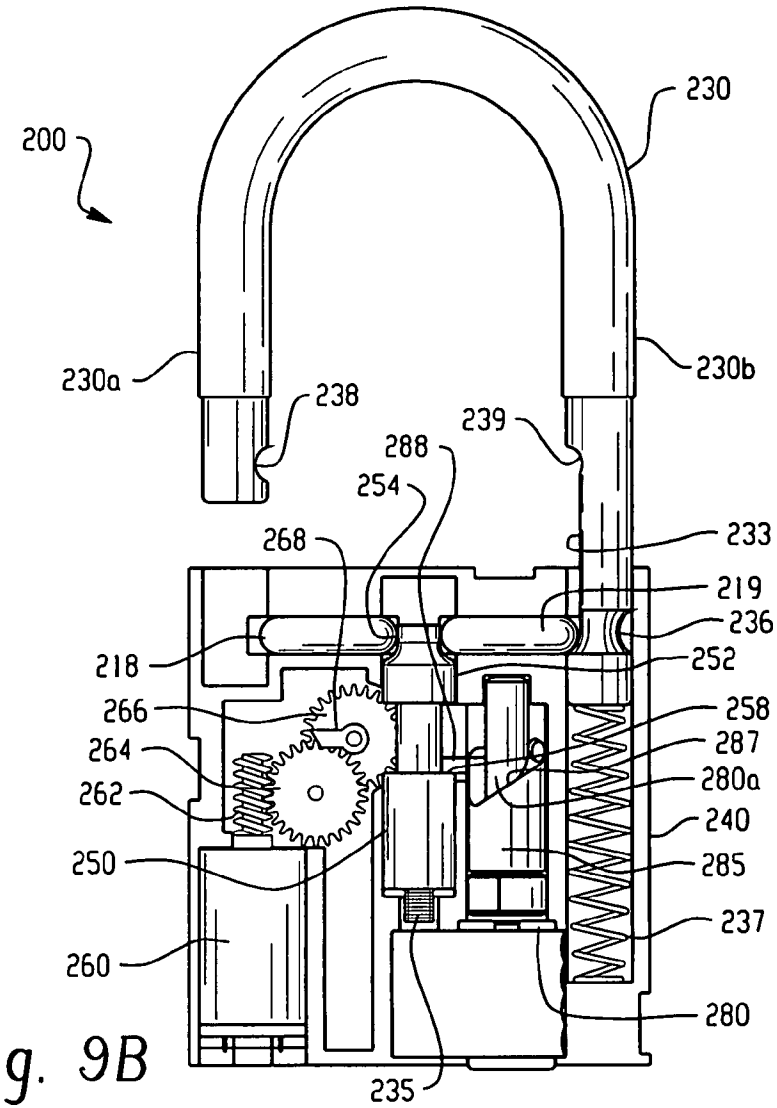
FIG. 9B is a front cross-sectional view of the padlock of FIG. 7 in an unlocked condition, as unlocked by a second mechanism.
Figure 9A:
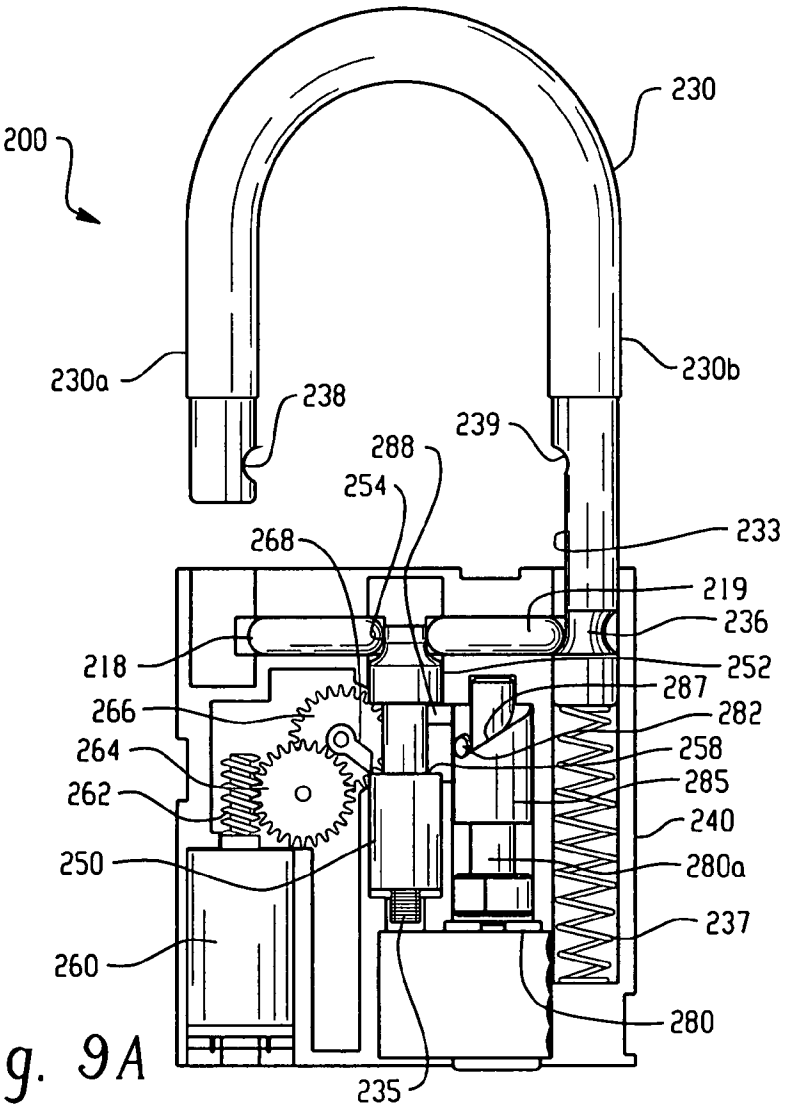
FIG. 9A is a front cross-sectional view of the padlock of FIG. 7 in an unlocked condition, as unlocked by a first mechanism.

A motor within a lock may be directly or indirectly coupled with one or more shackle engagement members to move or drive the shackle engagement members between positions of engagement and disengagement with a shackle, to move the lock between locked and unlocked conditions. In one embodiment, the motor may be connected with the shackle engagement members by a moveable shaft that directly or indirectly moves the shackle engagement members. This connection between the motor and shaft may be provided by one or more gears adapted to translate the output of the motor to the desired movement of the shaft, such as sliding, rotating, or pivoting movement. This connection between the motor and the shaft may be provided by a fixed linkage, or the connection may be disengageable; for example, the connection may include a displacement member driven by the motor to engage and move the shaft when the motor is operated. In the illustrated embodiment of FIGS. 7-9B, a motor 260 drives a worm gear 262, which in turn drives a series of spur gears 264, 265, 266. Spur gear 266 is provided with a displacement member or cam 268 that is positioned to engage a shoulder 258 on the shaft 250 when the motor 260 is operated. Upon engagement, as spur gear 266 continues to rotate, the cam 268 pushes the shaft 250 against the lock biasing member 235, causing the unlocking recess 254 of the shaft 250 to align with the shackle engagement members 218, 219, which allows the shackle engagement members to disengage from the locking recesses 238, 239 to release the shackle 230, allowing the shackle to open, as shown in FIG. 9A.

According to yet another aspect of the present invention, a padlock may be provided with a shackle biasing member to bias a shackle to move in an opening direction when the shackle is released from a locked or secured condition. In the illustrated embodiment of FIGS. 7-9B, the shackle biasing member includes a spring 237 disposed within the lock housing 240 below the long shackle leg 230*b*. When the shaft 250 is moved to align the shackle engagement members 218, 219 with the unlocking recess 254, the biasing force of the shackle biasing member 237 causes the shackle 230 to push the shackle engagement members 218, 219 into engagement with the unlocking recess 254, resulting in disengagement with the locking recesses 238, 239. The edges of the locking recesses 238, 239 and unlocking recess 254 may be contoured or angled to act as camming surfaces to facilitate this movement.

A padlock according to the present invention may provided with any number of mechanisms for retaining a long end of a shackle within a lock housing, and for re-locking the padlock by pressing or retracting the shackle back into the housing into a locked condition. In one embodiment one or more shackle engaging members may be at least partially returned to a shackle engaging position after the shackle has been opened. One such shackle engagement member may engage an end portion of a long shackle leg when the shackle is in an open position, thereby retaining the long shackle leg in the housing. Also, the shackle engagement members may further serve to re-engage corresponding locking recesses in the shackle when the shackle is pressed or retracted back into the housing, thereby securing the shackle in a locked condition. In the illustrated embodiment of FIGS. 7-9B, further operation of the motor 260 causes the cam 268 to disengage from the shoulder 258 of the shaft 250, allowing the lock biasing member 235 to move the shaft 250 upward. This upward movement of the shaft 250 causes the shackle engagement members 218, 219 to at least partially disengage from the unlocking recess 254 and move back towards a position of engagement with the shackle 230. As shown, the long shackle leg 230*b* may be provided with a retaining recess 236 which receives the partially extended shackle engagement member 219 to retain the long shackle leg 230*b* in the lock housing. When the shackle 230 is pressed or retracted back into the housing 240 to re-lock the padlock 200, shackle engagement member 219 rides along a recessed surface 233 of the long shackle leg 230*b* until the shackle engagement members 218, 219 are aligned with the locking recesses 238, 239. In this aligned position, the lock biasing member 235 forces the shackle engagement members 218 against the outer surface 252 and into full engagement with the locking recesses 238, 239, re-securing the shackle 230 in a locked condition.

In another aspect of the present invention, one or more batteries may be provided in the padlock to power the motor for operation, as well as any other electrical functions incorporated into the lock, such as, for example, a remote signal receiver or detector, a programmable circuit, or a digital or LED display. As shown in FIG. 7, a pair of AAA batteries 290 and corresponding battery contacts 291, 292 may be provided in an inner housing frame 242 of the lock housing 240 to offer a compact power source for the motor 260. A battery door 293 may be provided in the housing half 240*b* to provide external access to the batteries 290. As shown in FIG. 7, the batteries 290 may be electrically connected with a controller assembly 295, which includes a microcontroller, receiver, I/O switches, LED, and non-volatile data memory. A lens 299 may be provided in the housing half 240*a* to align with the receiver of the controller assembly 295, for receipt of input signals. Inner housing frame 242 may be assembled with a second inner housing frame 243 to enclose the shaft 250, motor 260 and other components of the locking arrangement.

According to another embodiment of the invention, a padlock with a motorized locking mechanism may also be provided with a mechanism for manual operation of the lock, such as, for example, by using a key or other such instrument to manually operate the lock to an unlocked condition. Such a mechanism may provide for a fail-safe means of opening the lock under circumstances in which a loss of electrical power, loss of or damage to a signal transmitter, or other such conditions prevent motorized operation of the locking mechanism. While many different manual operating mechanisms may be provided, the illustrated embodiment of FIGS. 7-9B shows one exemplary manual mechanism, in which a key-operated cylinder 280 is adapted for manual operation of the locking arrangement. As shown, the key cylinder 280 is provided with a sleeve 285 that is slidably and rotateably movable on a cylinder extension 280*a* connected with the cylinder 280. The cylinder extension 280*a* is provided with a dowel rod or pin 282 that rides along a camming surface 287 on the sleeve 285 when the cylinder extension 280*a* is rotated. The sleeve 285 is also provided with a displacement tab 288 that may be positioned to rest on the shoulder 258 of the shaft 250. When the key cylinder 280 is rotated from a locked position to an unlocked position, by the insertion of an authorized key into the keyway of the cylinder 280 (not shown), the pin 282 pushes against the camming surface 287 of the sleeve 285 to push the sleeve 285 downward. This downward movement of the sleeve causes the displacement tab 288 to push the shaft 250 against the lock biasing member 235, allowing the shackle engagement members 218, 219 to engage the unlocking recess 254 and disengage from the locking recesses 238, 239 to release the shackle 230 for opening, as shown in FIG. 9B. Additionally, the key cylinder 280 may be adapted to retain the key in the keyway until the cylinder 280 is returned to the locked position, thereby moving the shackle engagement members 218, 219 to retain the long shackle leg 230*b* in the housing and to re-engage the locking recesses 238, 239 when the shackle 230 is pushed or retracted back into the housing to re-lock the padlock.

Figure 10:
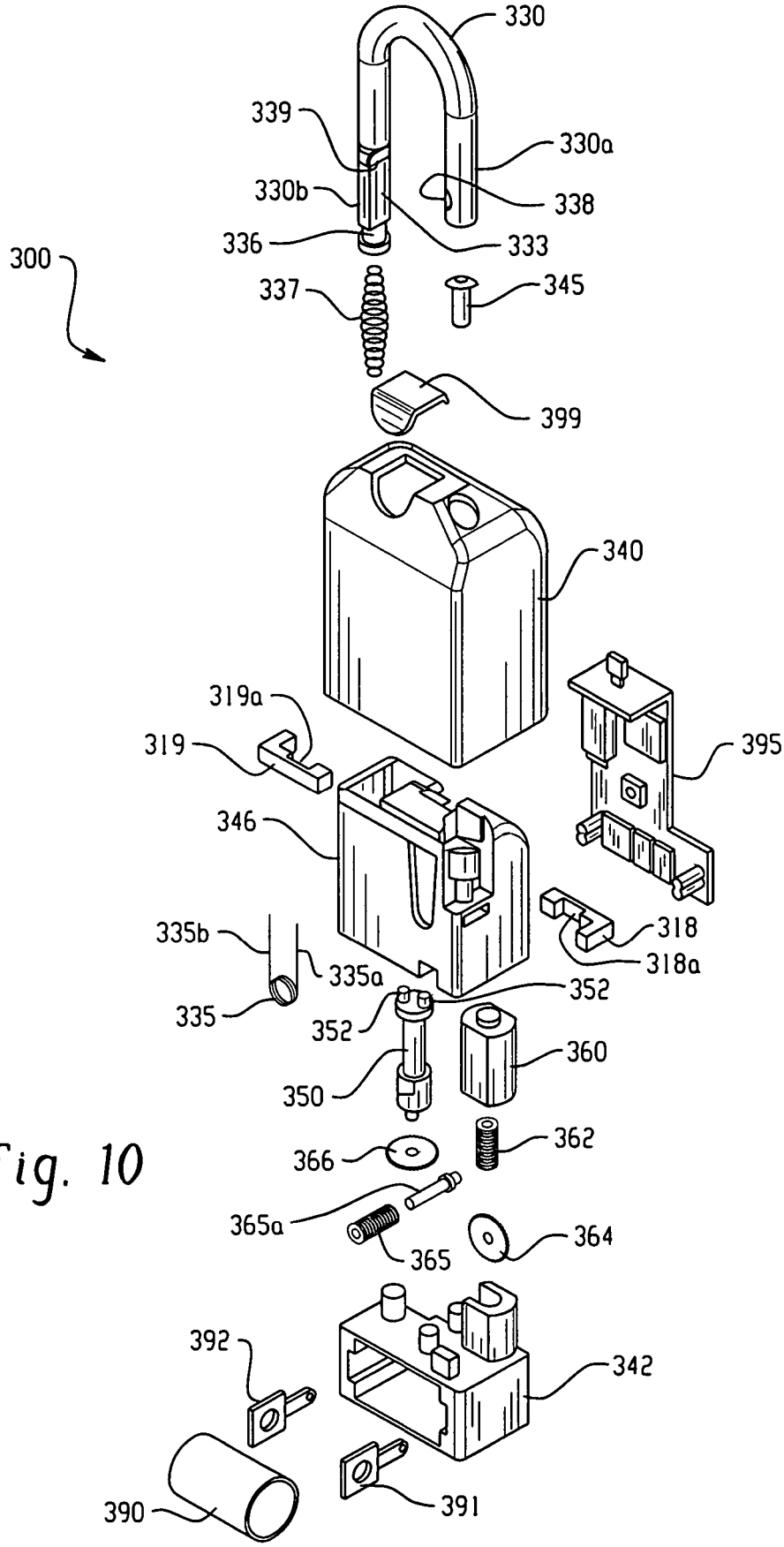
FIG. 10 is an exploded view of another remotely operated padlock.
Figure 11B:
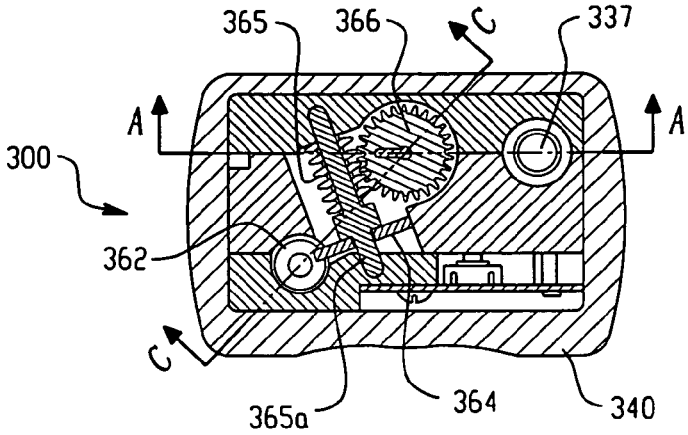
FIG. 11B is a top cross-sectional view of the padlock of FIG. 10 in an locked state.
Figure 11C:
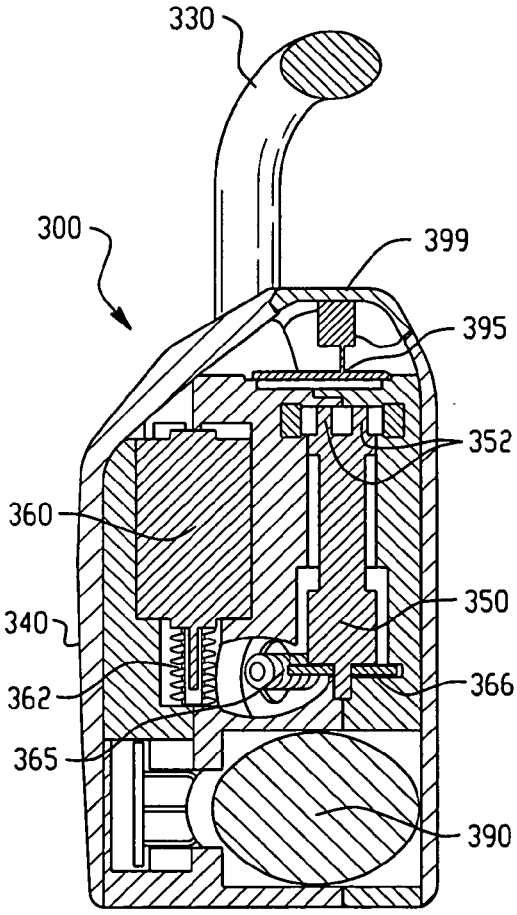
FIG. 11C is a side cross-sectional view of the padlock of FIG. 10 in a locked state.
Figure 11A:
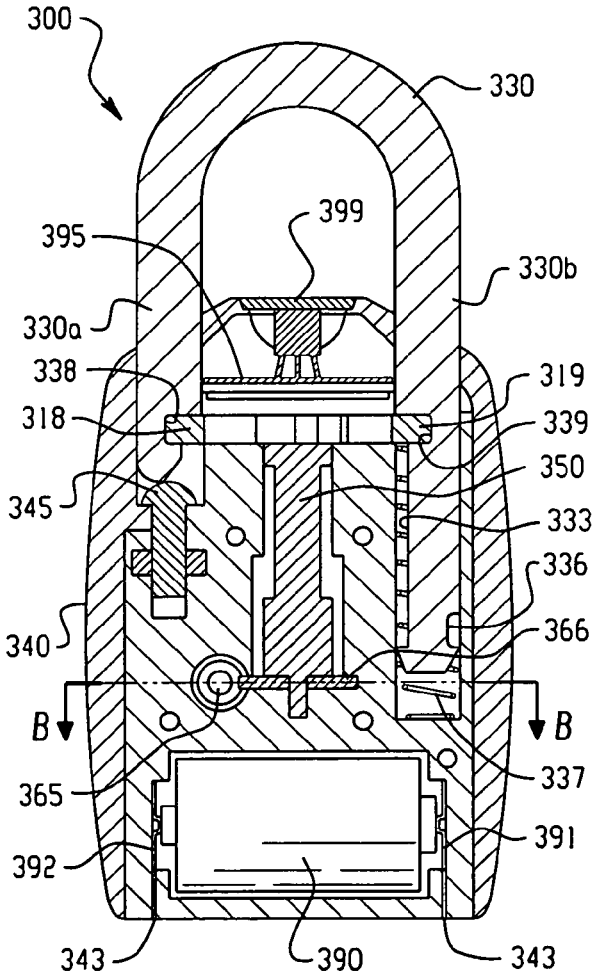
FIG. 11A is a front cross-sectional view of the padlock of FIG. 10 in a locked state.
Figure 12B:
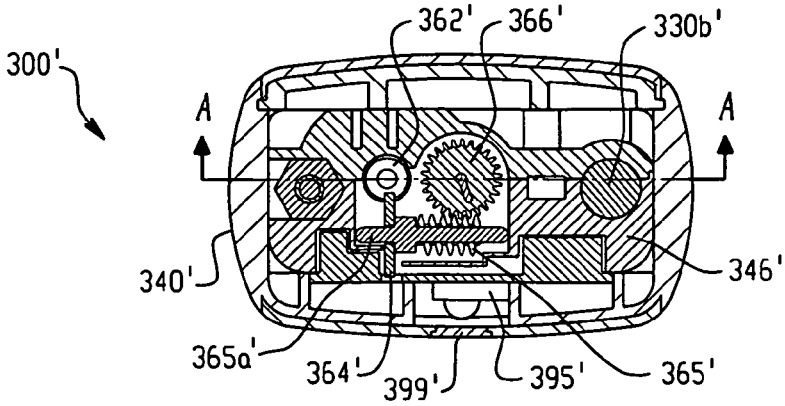
FIGS. 12A, 12B, and 12C are front, top, and side cross sectional views of another remotely operated padlock.
Figure 12C:
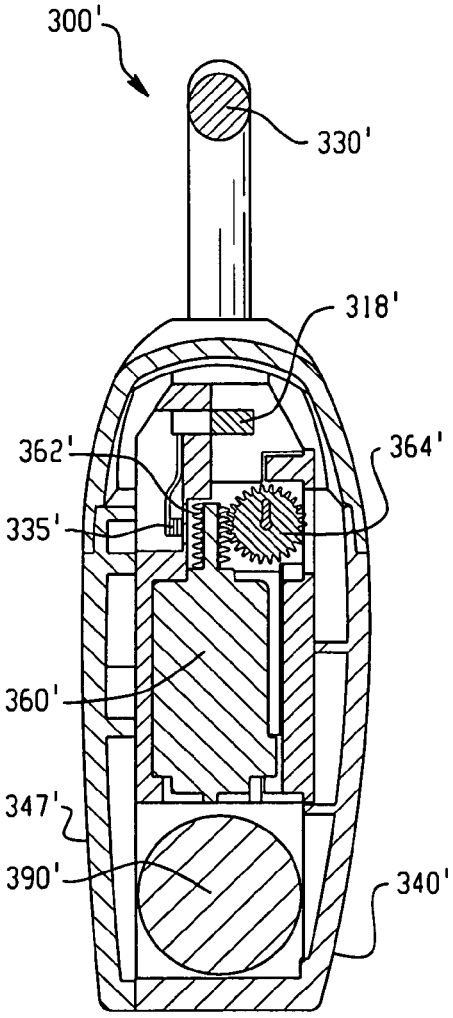
Figure 12A:
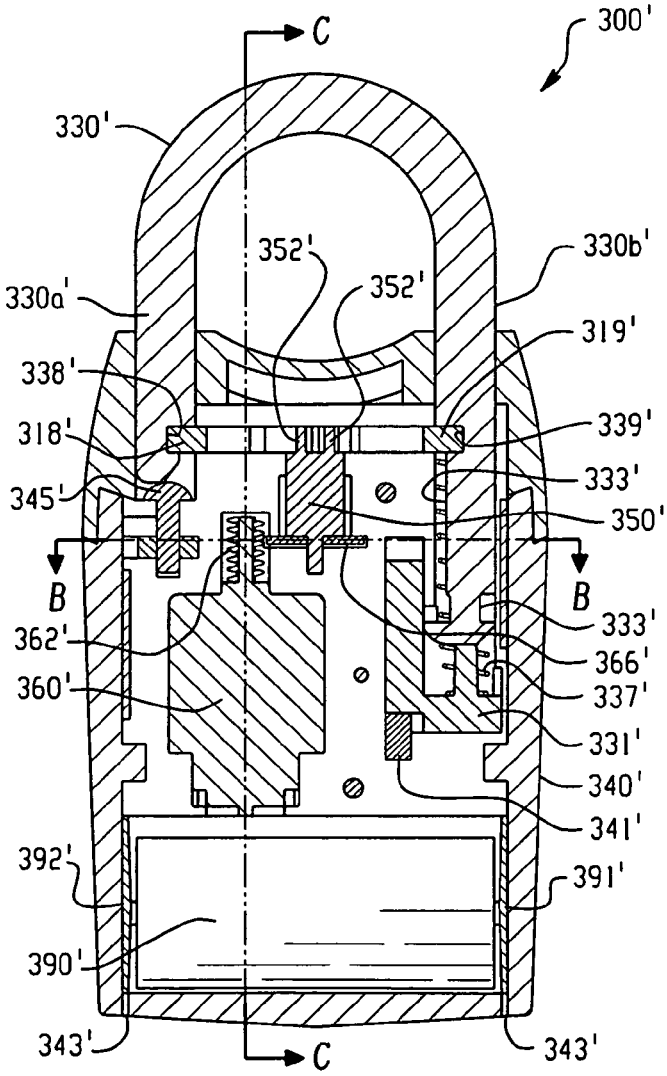

FIGS. 7-9B illustrate only one embodiment of a padlock adapted to be operated by a motorized locking mechanism, according to an aspect of the present invention. Many different mechanisms, components, and arrangements may be employed to carry out this aspect of the present invention. FIGS. 10-11C illustrate yet another exemplary padlock 300 according to aspects of the present invention. FIGS. 12A-C illustrate a further exemplary embodiment consistent in certain respects with the embodiment of FIGS. 10-11C, as evident to one of ordinary skill in the art. Corresponding reference numbers (non-prime in FIGS. 10-11C and prime in FIGS. 12A-C) have been used to identify corresponding components between the two embodiments.

The padlock 300 of the illustrated embodiment of FIGS. 10-11C includes a shackle 330 movable between locked and unlocked positions, in which a short leg 330*a* of the shackle 330 disengages from the lock housing 340 when the lock is opened, while a long leg 330*b* of the shackle 330 remains engaged within the lock housing 340. A pair of shackle engaging members 318, 319 engage corresponding locking recesses 338, 339 in the shackle to secure the shackle when the padlock 300 is in the locked condition. When the lock 300 is unlocked, the shackle engagement members 318, 319 are disengaged from the locking recesses 338, 339 to allow the shackle 330 to be moved in an opening direction. In the embodiment of FIGS. 10-11C, the shackle engagement members 318, 319 are levers that are slideable to engage and disengage with the locking recesses 338, 339.

In the illustrated embodiment, a rotateable shaft 350 is provided for moving the shackle engagement members 318, 319 between positions of engagement and disengagement with corresponding locking recesses 338, 339 in the shackle 330. The shaft 350 is provided with protrusions 352, 354 that are positioned to engage corresponding surfaces 318*a*, 319*a* of the shackle engagement members 318, 319 when the shaft 350 is rotated. When the shaft 350 is rotated beyond initial engagement between the protrusions 352, 354 and the surfaces 318*a*, 319*a*, the protrusions retract the shackle engagement members 318, 319 from the shackle to disengage the shackle engagement members from the locking recesses 338, 339 to allow the shackle 330 to move in an opening direction.

As shown in FIG. 10, a lock biasing member of the illustrated embodiment includes a two-pronged torsion spring 335, with each end 335*a*, 335*b* of the spring 335 attached to the respective shackle engagement member 318, 319. The spring 335 is adapted to bias the shackle engagement members 318, 319 towards engagement with the locking recesses 338, 339 of the shackle 330.

In the illustrated embodiment of FIGS. 10-11C, a motor 360 drives a worm gear 362, which in turn drives a spur gear 364 to rotate a second worm gear 365 on a pin 365*a*. The second worm gear 365 drives a second spur gear 366 attached to the shaft 350 for rotation of the shaft when the motor 360 is operated.

As shown in FIGS. 10-11C, a shackle biasing member includes a spring 337 disposed within the lock housing 340 below the long shackle leg 330*b*. When the shaft 350 is rotated to retract the shackle engagement members 318, 319 from the locking recesses 338, 339, biasing force of the shackle biasing member 237 causes the shackle 230 to move in an opening direction, thereby misaligning the shackle biasing members 318, 319 with the locking recesses 338, 339, to prevent any unintended re-locking of the shackle 330. Further operation of the motor 360 causes the shaft protrusions 352, 354 to ride along corresponding surfaces 318*a*, 319*a* until the protrusions 352, 354 disengage from the surfaces 318*a*, 319*a*, allowing the lock biasing member 335 to move the shackle engagement members 318, 319 back toward a position for engagement with the shackle 330. As shown, the long shackle leg 330*b* may be provided with a retaining recess 336 which receives the partially extended shackle engagement member 319 to retain the long shackle leg 330*b* in the lock housing. When the shackle 330 is pressed or retracted back into the housing 340 to re-lock the padlock 300, shackle engagement member 319 rides along a recessed surface 333 of the long shackle leg 330*b* until the shackle engagement members 318, 319 are aligned with the locking recesses 338, 339. In this aligned position, the lock biasing member 335 forces the shackle engagement members 318 into full engagement with the locking recesses 338, 339, re-securing the shackle 330 in a locked condition.

While the illustrated embodiment of FIGS. 10-11C does not show a manual operating mechanism for operating the lock without utilizing the motor, as depicted in the embodiment of FIGS. 7-9B, many different mechanisms may be incorporated into the exemplary padlock to provide for a fail-safe means of opening the lock under circumstances in which motorized operation of the locking mechanism is difficult or not possible.

In the illustrated embodiments of FIGS. 10-11C, a battery 390, such as a lithium camera battery, may be provided to power the motor and other electrical components. The battery 390 engages battery contacts 391, 392 in a battery enclosure 342 that also provides support for the motor 360 and shaft 350. As shown in FIGS. 10-11C, the battery 390 may be electrically connected with a controller assembly 395, which includes a microcontroller, receiver, I/O switches, LED, and non-volatile data memory. A lens 399 may be provided in the housing 340 to align with the receiver of the controller assembly 395, for receipt of input signals.

In an embodiment of the invention, the padlock may be adapted to prevent access to the lock's battery or batteries while the lock is in a locked condition. In the exemplary embodiment shown in FIG. 10, the padlock 300 requires disassembly of the lock housing 340 to access the battery 390. An assembly screw 345 may be accessed through an opening in the lock housing 340 from which the short shackle leg 330*a* is withdrawn when the padlock 300 is opened. This assembly screw 345 retains the battery enclosure 342 and an inner body 346, which houses the shaft 350, motor 360 and related mechanical workings of the lock. By loosening and removing the assembly screw 345, the battery enclosure 342, which defines the bottom surface of the lock 300, may be pushed out of the housing 340, such as by pressing a tool in the hole for the short shackle leg 330*a*, allowing the battery 390 to be replaced. In another embodiment, as shown in FIGS. 12A-C, a slide latch 331' is provided under the long shackle leg 330*b*' to secure a tab 341' extending into the lock 300' from a battery door 347' when the lock 300' is in the locked condition. When the lock 300' is unlocked and the shackle 330' is extended, the slide latch 331' becomes free to lift out of engagement with the tab 341', allowing the battery door 347' to be opened.

In another aspect of the present invention, a motor operated lock may be provided with access ports to allow use of an external power source to operate the locking arrangement. This feature may be particularly advantageous for any embodiment in which an internal battery may not be accessed when the lock is in a locked condition. While many different methods may be used to supply external power to the lock motor, in the illustrated embodiment of FIGS. 10-11C, the battery enclosure 342 is provided with two small access holes 343, disposed on the bottom surface of the lock 300, that align with battery contacts 391, 392. By inserting leads (not shown) into the access holes 343, a battery or other power source of suitable voltage may be connected to the leads to power the motor 360 to operate when an authorized signal is transmitted to the lock.

While several embodiments of the invention has been illustrated and described in considerable detail, the present invention is not to be considered limited to the precise constructions disclosed. Various adaptations, modifications and uses of the invention may occur to those skilled in the arts to which the invention relates. It is the intention to cover all such adaptations, modifications and uses falling within the scope or spirit of the claims filed herewith.

We claim:

1. An electronic padlock comprising:

a lock housing;

a shackle movably coupled to the lock housing for vertical movement between a locked condition and a withdrawn condition;

a blocker disposed within the lock housing, the blocker being vertically movable from a shackle securing position, in which the blocker forces at least one shackle engagement member into locking engagement with the shackle, to a shackle releasing position, in which the blocker allows the at least one shackle engagement member to disengage from the shackle for withdrawal of the shackle from the lock housing;

a motor disposed within the lock housing, the motor being configured to move a displacement member into engagement with the blocker for vertical movement of the blocker from the shackle securing position to the shackle releasing position in response to receipt of an electrical signal, the motor being further configured to move the displacement member out of engagement with the blocker to allow the blocker to move from the shackle releasing position to the shackle securing position;

a lock biasing member disposed within the housing for biasing the blocker toward the shackle securing position, such that when the motor moves the displacement member out of engagement with the blocker, the lock biasing member returns the blocker to the shackle securing position; and an electronic lock interface assembled with the lock housing and configured to supply an electrical signal to the motor in response to receipt of an authorized signal.

2. The electronic padlock of claim 1, wherein the electronic lock interface comprises a receiver configured to receive a remotely transmitted authorized signal.

3. The electronic padlock of claim 1, wherein the motor comprises a rotary motor.

4. The electronic padlock of claim 1, further comprising a shackle biasing member configured to move the shackle from the locked condition to the withdrawn condition when the blocker is moved from the shackle securing position to the shackle releasing position.

5. The electronic padlock of claim 1, wherein the motor rotates about an axis substantially parallel to and spaced apart from a central axis of the blocker.

6. The electronic padlock of claim 1, wherein the displacement member rotates about an axis substantially perpendicular to and spaced apart from a central axis of the blocker.

7. The electronic padlock of claim 1, wherein the displacement member rotates about an axis substantially perpendicular to and spaced apart from a rotational axis of the motor.

8. The electronic padlock of claim 1, wherein when the electronic lock interface supplies an electrical signal to the motor, the motor rotates to move the displacement member into engagement with the blocker to move the blocker from the shackle securing position to the shackle releasing position, the shackle moves from the locked condition to the withdrawn condition, the motor further rotates to disengage the displacement member from the blocker, and the blocker moves from the shackle releasing position toward the shackle engaging position.

9. The electronic padlock of claim 1, further comprising a key operated lock mechanism assembled with the lock housing, the key operated lock mechanism moving the blocker from the shackle securing position to the shackle releasing position upon insertion and rotation of an authorized key in a keyway of the key operated lock mechanism.

10. The electronic padlock of claim 9, wherein the key operated lock mechanism comprises a rotatable key cylinder extension surrounded by a sleeve, wherein rotation of the key cylinder extension vertically moves the sleeve into engagement with the blocker for movement of the blocker from the shackle securing position to the shackle releasing position.

11. The electronic padlock of claim 9, wherein the key operated lock mechanism moves the blocker from the shackle securing position to the shackle releasing position independent of the displacement member.

12. The electronic padlock of claim 1, wherein the motor is configured to rotate the displacement member into engagement with the blocker.

13. The electronic padlock of claim 1, wherein the motor is configured to move the displacement member into engagement with a shoulder of the blocker.

14. A method of unlocking an electronic padlock having a lock housing and a shackle movably coupled to the lock housing for vertical movement between a locked condition and a withdrawn condition, the method comprising:

providing an authorized data signal to an electronic lock interface of the padlock;

delivering an electrical signal from the electronic lock interface to a motor disposed within the electronic padlock in response to receipt of the authorized data signal;

operating the motor to selectively engage a blocker disposed within the lock housing for vertical movement of the blocker from a shackle securing position, in which the blocker forces at least one shackle engagement member into locking engagement with the shackle, to a shackle releasing position, in which the blocker allows the at least one shackle engagement member to disengage from the shackle for withdrawal of the shackle from the lock housing; and operating the motor to disengage the blocker, such that the blocker is automatically moved toward the shackle securing position by a lock biasing member disposed within the lock housing.

15. The method of claim 14, wherein providing the authorized data signal to the electronic lock interface comprises delivering a signal from a remote transmitter.

16. The method of claim 14, wherein operating the motor to selectively engage the blocker comprises rotating a displacement member into engagement with a shoulder of the blocker.

17. The method of claim 14, further comprising automatically moving the shackle from the locked condition to the withdrawn condition in response to movement of the blocker from the shackle securing position to the shackle releasing position.

18. The method of claim 14, wherein operating the motor comprises rotating the motor about an axis substantially parallel to and spaced apart from a central axis of the blocker.

19. A padlock comprising a lock housing;

a shackle movably coupled to the lock housing for vertical movement between a locked condition and a withdrawn condition;

a blocker disposed within the lock housing, the blocker being vertically movable from a shackle securing position, in which the blocker forces at least one shackle engagement member into locking engagement with the shackle, to a shackle releasing position, in which the blocker allows the at least one shackle engagement member to disengage from the shackle for withdrawal of the shackle from the lock housing; and a key operated lock mechanism assembled with the lock housing, the key operated lock mechanism moving the blocker from the shackle securing position to the shackle releasing position upon insertion and rotation of an authorized key in a keyway of the key operated lock mechanism, the key operated lock mechanism comprising a rotatable key cylinder extension surrounded by a rotationally fixed, vertically movable sleeve, wherein rotation of the key cylinder extension with the inserted authorized key causes a radially extending portion of the key cylinder extension to engage an angled camming surface of the sleeve to vertically move the sleeve into engagement with the blocker for vertical movement of the blocker from the shackle securing position to the shackle releasing position.

20. The padlock of claim 19, further comprising an electromechanical locking mechanism disposed within the lock housing, the electromechanical locking mechanism being configured to vertically move the blocker from the shackle securing position to the shackle releasing position in response to an authorized signal received at an electronic lock interface assembled with the lock housing.

21. The padlock of claim 20, wherein the electromechanical locking mechanism comprises a motor disposed within the lock housing, the motor being configured to rotate a displacement member into engagement with the blocker for movement of the blocker from the shackle securing position to the shackle releasing position.

* * * * *